US011128063B2

(12) United States Patent
Yu

(10) Patent No.: US 11,128,063 B2
(45) Date of Patent: Sep. 21, 2021

(54) SOCKET PLASTIC HARDWARE STRUCTURE DEVICE

(71) Applicant: Zhenjiang Electrics (Shenzhen) Co., Ltd., Shenzhen (CN)

(72) Inventor: Yongrong Yu, Sichuan Province (CN)

(73) Assignee: Zhenjiang Electrics (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 16/997,227

(22) Filed: Aug. 19, 2020

(65) Prior Publication Data

US 2021/0057829 A1 Feb. 25, 2021

(30) Foreign Application Priority Data

Aug. 20, 2019 (CN) ..... 201921356421.2

(51) Int. Cl.
*H01R 4/48* (2006.01)
*H01R 25/00* (2006.01)
*H01R 13/447* (2006.01)

(52) U.S. Cl.
CPC ..... *H01R 4/48* (2013.01); *H01R 25/003* (2013.01); *H01R 13/447* (2013.01)

(58) Field of Classification Search
CPC .... H01R 4/48; H01R 25/003; H01R 13/7033; H01R 13/71; H01R 24/76; H01R 27/02; H01R 13/447
See application file for complete search history.

(56) References Cited

U.S. PATENT DOCUMENTS

2020/0136321 A1* 4/2020 Hu ..... H01R 13/447

FOREIGN PATENT DOCUMENTS

WO WO-2019010613 A1 * 1/2019 ..... H01R 13/7031

* cited by examiner

*Primary Examiner* — Tho D Ta
(74) *Attorney, Agent, or Firm* — Bay State IP, LLC

(57) ABSTRACT

An extension lead with a conductive piece in a first socket of the extension lead is provided separately from a conductive part connected to a power cord connection piece. A rotating part for driving the conductive piece or the conductive part to move to and contact with the other of the conductive piece or the conductive part is further provided. When a male tab of the plug is inserted into the first socket, the male tab pushes the rotating part to rotate, and drives the conductive piece or the conductive part to move to and contact with the other of the conductive piece or the conductive part, and the circuit is turned on at this time. When the male tab is pulled out from the first socket, the conductive piece and the conductive part return to their original positions, and the conductive piece is not charged at this time.

10 Claims, 7 Drawing Sheets

SOCKET PLASTIC HARDWARE STRUCTURE DEVICE

CROSS REFERENCE TO RELATED APPLICATION

This application claims the priority to and takes the benefit of Chinese Patent Application serial number of 201921356421.2 filed on Aug. 20, 2019, the contents of which are herein incorporated by reference.

BACKGROUND OF THE INVENTION

Field of the Invention

The present invention relates to the technical field of household appliances, and more specifically, to a socket plastic hardware structure device.

Description of the Related Art

Extension leads can be seen everywhere in real life and are indispensable. The traditional extension lead comprises a socket, and a conductive piece is provided in the socket. The conductive piece is always charged. When the socket is idle and the plug of other electrical appliances is not inserted, the conductive piece in the socket is still in a charged state. When a non-standard conductor such as iron is inserted into the socket by mistake, water may splash into the socket, or there will be a risk of electric shock or short circuit.

Therefore, a technical problem to be solved urgently by those skilled in the art is how to make an extension lead that can effectively prevent electric shock or short-circuit due to the fact that a non-standard conductor such as iron is s inserted into the socket by mistake or water splashes into the socket.

SUMMARY OF THE INVENTION

In order to overcome the problems in the related art at least to a certain extent, the object of the present invention is to provide a socket plastic hardware structure device, which can effectively prevent electric shock or short-circuit due to the fact that a non-standard conductor is inserted into the socket by mistake or water splashes into the socket.

The present invention is realized through the following technical solutions.

The present invention provides a socket plastic hardware structure device, comprising a housing provided with a first socket, wherein a conductive part connected with a power cord connecting piece and a conductive piece in contact with a male tab of a plug are provided in the housing, the conductive piece is provided with a clamping portion for clamping the male tab, and the clamping portion is located directly below the first socket, wherein the conductive piece is further provided with a first contact portion extending from the clamping portion, the conductive part is provided with a second contact portion, a gap is provided between the first contact portion and the second contact portion, the first contact portion or the second contact portion is provided in an elastic structure, a rotating part made of insulating material is rotatably provided in the housing, the rotating part is provided with a first protrusion protruding in the direction of the edge of the first socket, the first protrusion is located below the first socket, when the male tab is inserted into the first socket, the male tab pushes the rotating part to rotate and thereby pushes one of the first contact portion and the second contact portion to elastically deform so as to approach and contact with the other of the first contact portion and the second contact portion, when the male tab is pulled out of the first socket, the first contact portion or the second contact portion that has undergone elastic deformation recovers from the elastic deformation, and the first contact portion is separated from the second contact portion.

Preferably, the rotating part further comprises a second protrusion and a rotating shaft portion rotatably provided on the housing, and the second protrusion protrudes in the direction of the first contact portion or the second contact portion.

Preferably, the second contact portion is provided as a horizontally provided horizontal plate and a vertically provided second contact plate which are connected vertically to each other, the first contact portion is provided such that a vertically provided vertical plate and a first contact plate are vertically connected to each other, a gap is provided between the first contact plate and the second contact plate, and the second contact plate is located on one side of the rotating part.

Preferably, the first contact plate and the second contact plate are both provided with conductive contacts protruding toward each other at corresponding positions, and a gap is provided between the two conductive contacts.

Preferably, the conductive piece and the conductive part are both formed by bending a copper plate.

Preferably, the conductive contact is provided with a boss, the first contact plate and the second contact plate are both provided with a through hole, and the conductive contact is clamped in the through hole through the boss.

Preferably, the housing comprises a bottom shell, the bottom shell is covered with an upper shell, the upper shell is provided with the first socket, a fixing structure is further provided in the bottom shell, the fixing structure comprises a lower shell, an upper cover and a fixing member, the lower shell is covered with the upper cover, the fixing member is provided between the lower shell and the upper cover, the upper cover is provided with a first semi-cylindrical groove matching the rotating shaft portion and a second socket corresponding to the position of the first socket, the fixing member is provided with a second semi-cylindrical groove matching the rotating shaft portion, the rotating shaft portion is rotatably provided in a cylindrical groove formed by buckling the first semi-cylindrical groove and the second semi-cylindrical groove, and the fixing member is further provided with a neck for fixing the conductive piece and the conductive part.

Preferably, the socket plastic hardware structure device is further provided with a USB interface.

Preferably, the bottom shell 1 is provided with a heat dissipation hole.

The present invention further provides a socket plastic hardware structure device, comprising a bottom shell and an upper shell covering the bottom shell, wherein the upper shell is provided with a first socket, a conductive part connected with a power cord connecting piece and a conductive piece in contact with a male tab of a plug are provided in the bottom shell, the conductive piece is provided with a clamping portion for clamping the male tab, and the clamping portion is located directly below the first socket, wherein the conductive piece is further provided with a first contact portion extending from the clamping portion, the conductive part is provided with a second contact portion, a gap is provided between the first contact portion and the second contact portion, a rotating part is rotatably provided in the bottom shell, the rotating part is provided with a first protrusion protruding in the direction of the edge of the first socket, the first protrusion is located below the first socket, wherein the device further comprises a conductive connector, the conductive connector is provided with two contact portions, one end of the conductive connector is connected with an elastic member, the other end of the elastic member is connected with the inner wall of the bottom shell, the second end of the conductive connecting piece is located on one side of the rotating part, when the male tab is inserted into the first socket, the male tab pushes the rotating part to rotate and pushes the conductive connecting piece to move until the two contact portions thereof are in contact with the first contact portion and the second contact portion, respectively, and when the male tab is pulled out of the first socket, the elastic member returns to its original shape and pushes the conductive connector until the two contact portions thereof are separated from the first contact portion and the second contact portion, respectively.

The technical solution provided by the present invention may comprise the following beneficial effects.

A conductive piece in a first socket of the extension lead is provided separately from a conductive part connected to a power cord connection piece. A rotating part for driving the conductive piece or the conductive part to move to and contact with the other of the conductive piece or the conductive part is further provided. When a male tab of the plug is inserted into the first socket, the male tab pushes the rotating part to rotate, and drives the conductive piece or the conductive part to move to and contact with the other of the conductive piece or the conductive part, and the circuit is turned on at this time. When the male tab is pulled out from the first socket, the conductive piece and the conductive part return to their original positions, and the conductive piece is not charged at this time. In such a way, when a finger of child or a non-standard conductor is inserted into the first socket by mistake, there will be no risk of electric shock; when water splashes into the first socket, a short circuit will not occur.

BRIEF DESCRIPTION OF THE DRAWINGS

The drawings herein are incorporated into the specification and constitute a part of the specification, show embodiments in accordance with the present invention, and are used to explain the principle of the present invention together with the specification.

In order to explain the embodiments of the present invention or the technical solutions in the prior art more clearly, the drawings that need to be used in the description of the embodiments or the prior art will be briefly introduced. Obviously, the drawings in the following description are only some embodiments of the present invention. For those skilled in the art, other drawings can be obtained based on these drawings without paying creative labor.

Figure 1:
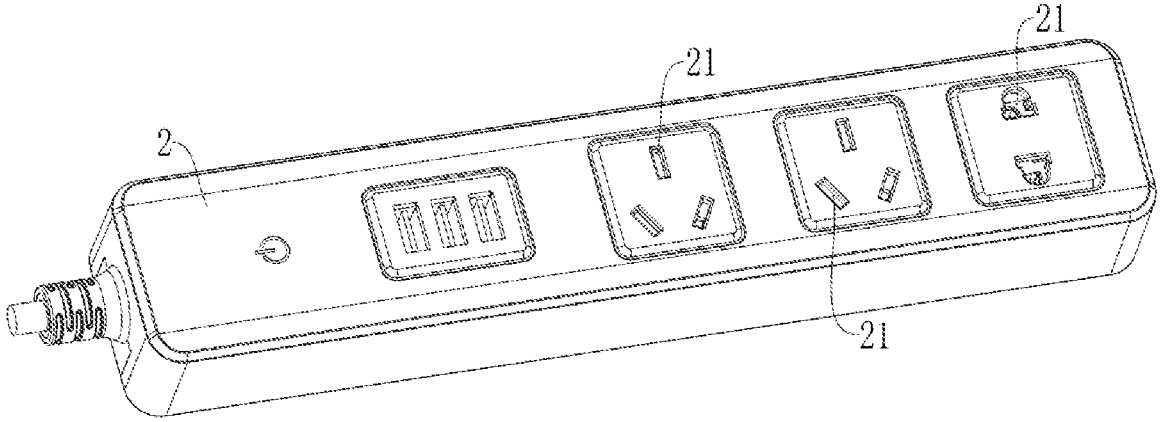
FIG. 1 is a schematic structural diagram of a socket plastic hardware structure device according to some embodiments.
Figure 2:
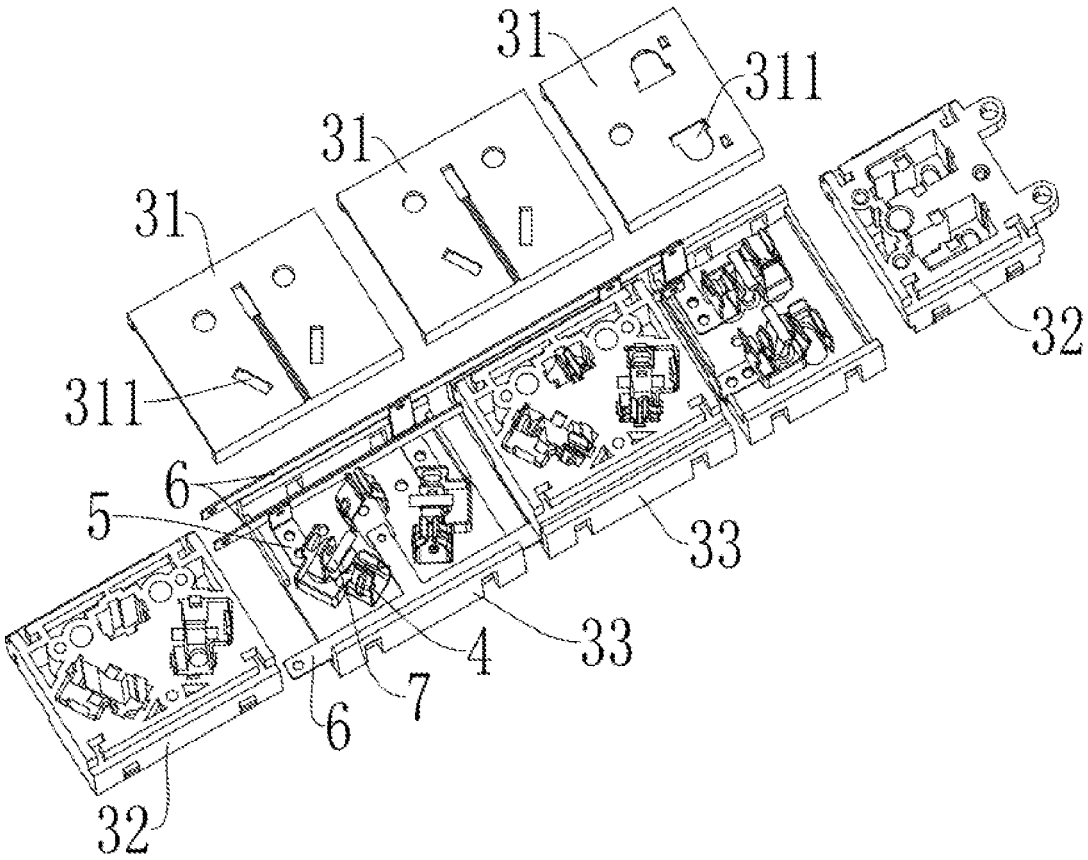
FIG. 2 is a schematic diagram of the internal structure of a fixing structure of a socket plastic hardware structure device according to some embodiments.

In the figures: 1—bottom shell, 2—upper shell, 3—fixing part, 4—conductive piece, 5—conductive part, 6—power cord connection piece, 7—rotating part, 8—conductive contact, 9—conductive connector, 10—spring, 11—heat dissipation hole, 12—circuit board, 13—USB interface, 14—transformer, 21—first socket, 31—upper cover, 32—fixing member, 33—lower shell, 41—first contact portion, 42—clamping portion, 51—second contact portion, 71—rotating shaft portion, 72—first protrusion, 73—second protrusion, 311—second socket, 312—first semi-cylindrical groove, 321—second semi-cylindrical groove. 411—vertical plate, 412—first contact plate, 511—horizontal plate, 512—second contact plate.

DETAILED DESCRIPTION OF THE SEVERAL EMBODIMENTS

The exemplary embodiments will be described in detail here, and examples thereof are shown in the accompanying drawings. When the following description refers to the drawings, unless otherwise indicated, the same numbers in different drawings indicate the same or similar elements. The implementation manners described in the following exemplary embodiments do not represent all implementation manners consistent with the present invention. Rather, they are merely examples of devices or methods consistent with some aspects of the present invention.

In order to make the objectives, technical solutions and advantages of the present invention clearer, the technical solutions of the present invention will be described in detail below Obviously, the described embodiments are only some embodiments of the present invention, rather than all the embodiments. Based on the embodiments of the present invention, all other implementation manners obtained by those skilled in the art without paying creative labor shall fall within the protection scope of the present invention.

Hereinafter, embodiments will be described with reference to the drawings. In addition, the embodiments shown below do not limit the content of the present invention described in the claims in any way. In addition, all the contents of the configuration shown in the following embodiments are not limited to what is necessary as a solution to the present invention described in the claims.

Referring to FIGS. 1 to 13, the present invention comprises a housing provided with a first socket 21, wherein the housing is provided with: a conductive part 5, wherein the conductive part 5 is connected with a power cord connecting piece 6; a conductive piece 4, wherein the conductive piece 4 is provided with a clamping portion 42, and the clamping portion 42 is located directly below the first socket 21 for clamping the male tab inserted into the plug of the first socket 21. The conductive piece 4 is further provided with a first contact portion 41 extending from the clamping portion 42, the conductive part 5 is provided with a second contact portion 51, a gap is provided between the first contact portion 41 and the second contact portion 51, the first contact portion 41 or the second contact portion 51 is provided in an elastic structure, a rotating part 7 made of insulating material is rotatably provided in the housing, the rotating part 7 is provided with a first protrusion 72 protruding in the direction of the edge of the first socket 21, and the first protrusion 72 protrudes from the edge of the first socket 21 in a direction perpendicular to the depth of the first socket 21 and is located below the first socket 21. When the male tab is inserted into the first socket 21, the edge of the male tab touches the first protrusion 72 and pushes the male tab pushes the rotating part 7 to rotate and thereby pushes one of the first contact portion 41 and the second contact portion 51 to elastically deform so as to approach and contact with the other of the first contact portion 41 and the second contact portion 51, the conductive piece is charged and the circuit is turned on at this time; when the male tab is pulled out of the first socket 21, the first contact portion 41 or the second contact portion 51 that has undergone elastic deformation recovers from the elastic deformation, the first contact portion 41 is separated from the second contact portion 51, and the conductive piece 4 is not charged at this time. In such a way, only when the socket plastic hardware structure is used, that is, when a plug of another electrical appliance is inserted into the first socket 21, the conductive piece 4 is charged and the circuit is turned on. When the first socket 21 is in an idle state, the conductive piece 4 is not charged. When water splashes into the first socket 21, a short circuit will not occur; or when a finger of child touches the first socket 21 or a non-standard conductor is inserted into the first socket 21 by mistake, there will be no electric shock.

Figure 3:
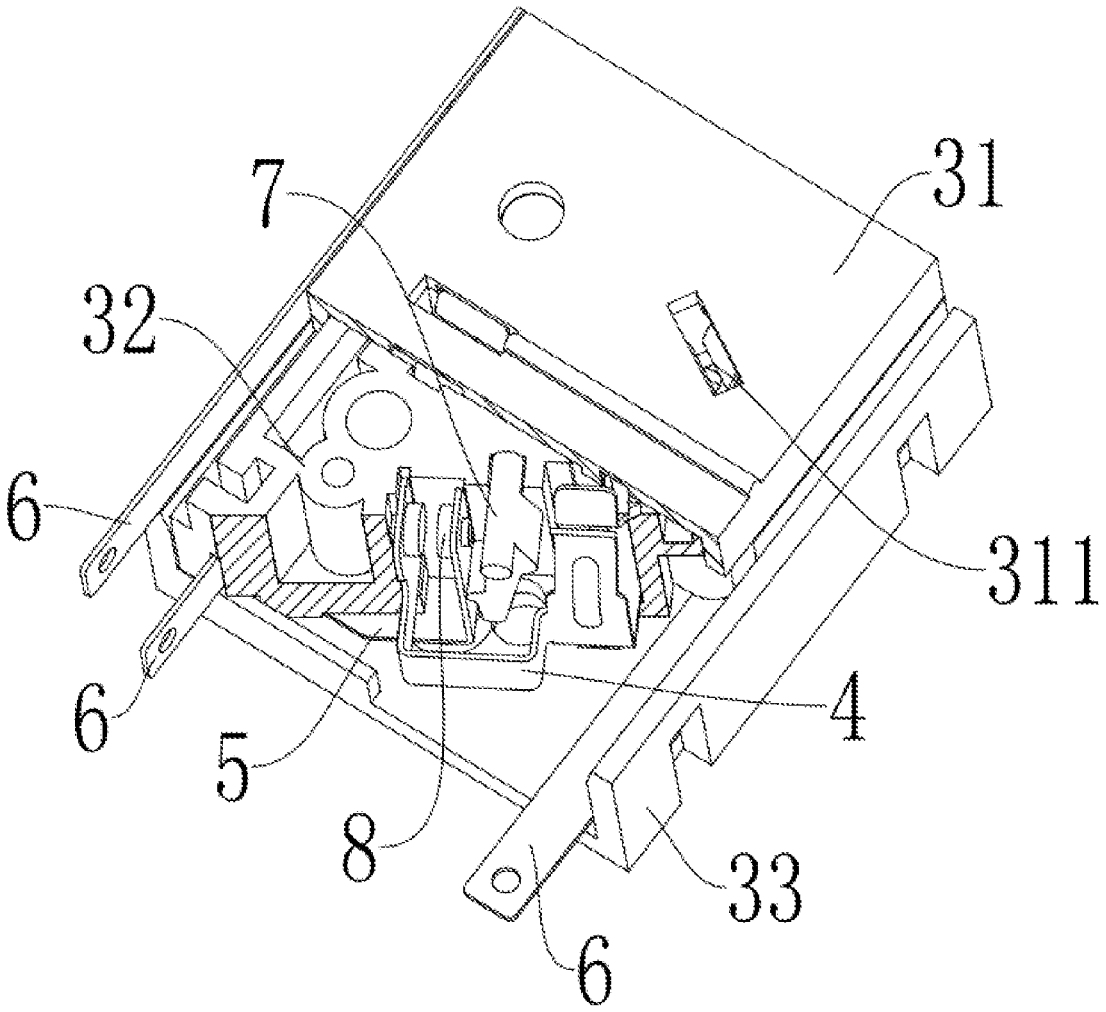
FIG. 3 is a schematic structural diagram of a connection relationship between a conductive part and a conductive piece of a socket plastic hardware structure device according to some embodiments.
Figure 4:
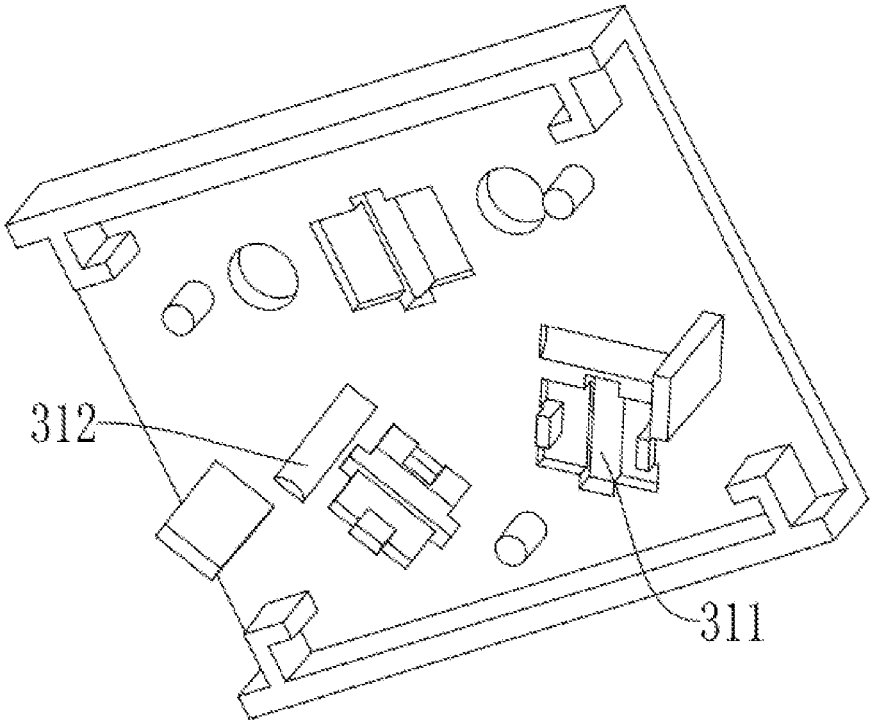
FIG. 4 is a schematic structural diagram of an upper cover of a socket plastic hardware structure device according to some embodiments.
Figure 5:
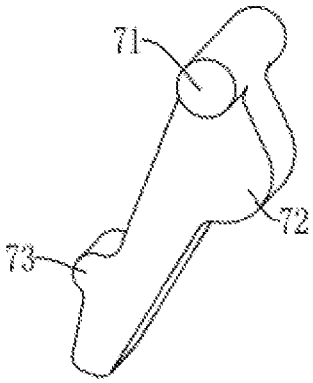
FIG. 5 is a schematic structural diagram of a rotating part of a socket plastic hardware structure device according to some embodiments.

The rotating part 7 is further provided with a second protrusion 73 and a rotating shaft portion 71. As shown in FIG. 5, the rotating shaft portion 71 can be configured as a cylindrical shape, and a cylindrical groove matching the rotating shaft portion 71 can be provided in the housing. The rotating part 7 is rotatably provided in the housing in such a way that the rotating shaft portion 71 is matched with the cylindrical groove. The first protrusion 72 and the second protrusion 73 may both be configured as arc-shaped protrusions. As shown in FIG. 3, the second protrusion 73 protrudes in the direction of the first contact portion 41 or the second contact portion 51. It should be noted that only a small part of the first protrusion 72 is exposed at the edge below the first socket 21. The non-standard conductor can drive the conductive piece 4 to be in contact with the conductive part 5 to be charged and thus get an electric shock only when the non-standard conductor is inserted into, is in contact with and pushes the first protrusion 72 at the edge. However, the conductive piece 4 or the conductive part 5 is in an elastic structure, and the first protrusion 72 can be provided in an arc shape. When the non-standard conductor pushes the first protrusion 72 to rotate, under the elastic reaction force, the conductive piece 4 or the conductive part 5 will push the non-standard conductor to move in the direction away from the first protrusion 72. Since the first protrusion 72 is arc-shaped, the non-standard conductor will slide or move by mistake with respect to the first protrusion 72, so that it is not easy to push the rotating part 7 to rotate, thereby charging the conductive piece 4, which may result in a risk of electric shock. Only when the male tab has the same size as that of the first socket 21, the male tab is clamped by the clamping portion 42, and can smoothly push the rotating part 7 to rotate so that the circuit is turned on when being inserted stably downwards. The distance between the first contact portion 41 and the second contact portion 51 may be provided such that the first contact portion 41 and the second contact portion 51 are just in contact with each other when the male tab is inserted to the bottom end, which further reduces the possibility of electric shock.

Figure 7:
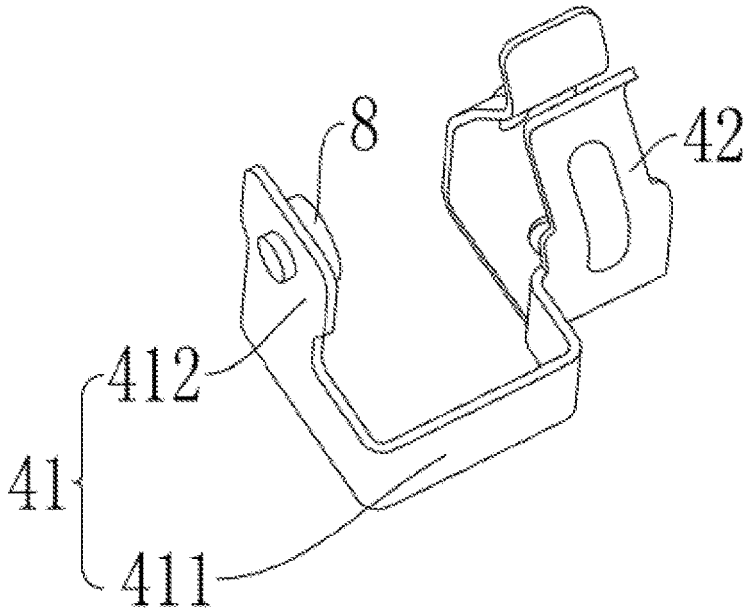
FIG. 7 is a schematic structural diagram of a conductive piece of a socket plastic hardware structure device according to some embodiments.
Figure 8:
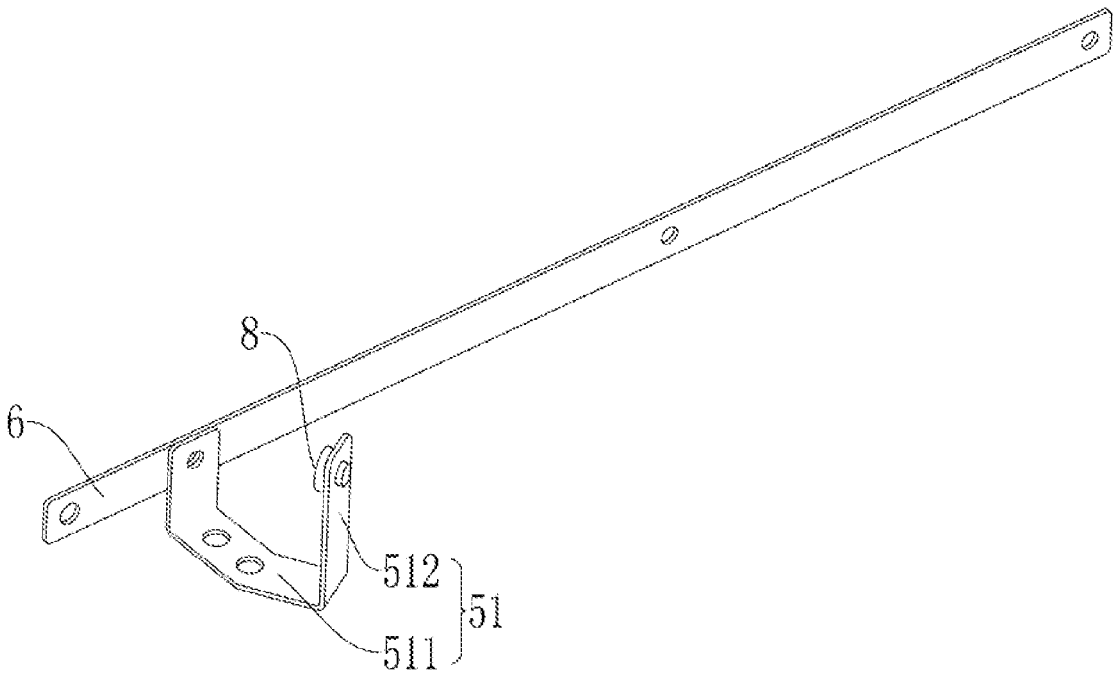
FIG. 8 is a schematic structural diagram of a conductive part of a socket plastic hardware structure device according to some embodiments.

As shown in FIG. 8, the second contact portion 51 may be provided as a horizontally provided horizontal plate 511 and a vertically provided second contact plate 512 which are connected vertically to each other. As shown in FIG. 7, the first contact portion 41 is provided such that a vertically provided vertical plate 411 and a first contact plate 412 are vertically connected to each other. As shown in FIG. 3, a gap is provided between the first contact plate 412 and the second contact plate 512, and the second contact plate 512 is located on one side of the rotating part 7. The horizontal plate 511 is located under the vertical plate 411 and the first contact plate 412 and is not in contact with each other. When the male tab is inserted into the first socket 21, the male tab pushes the first protrusion 72 to drive the rotating part 7 to rotate, and the second protrusion 73 pushes the second contact plate 512 to bend toward and contact the first contact plate 412 so that the conductive piece 4 is charged. In such a way, the structure is simple and less space is occupied, so that the volume of the socket plastic hardware structure device is reduced.

The first contact plate 412 and the second contact plate 512 are both provided with conductive contacts 8 protruding toward each other at corresponding positions. As shown in FIG. 3, a gap is provided between the two conductive contacts 8. The conductive contact 8 is added, so that it is easier to conduct the conductive part 5 and the conductive piece 4.

Both the conductive piece 4 and the conductive part 5 are formed by bending a copper plate. Copper has good electrical conductivity and good plasticity. Both the conductive piece 4 and the conductive part 5 are formed by bending a copper plate, which is simple to manufacture.

The conductive contact 8 is provided with a boss, the first contact plate 412 and the second contact plate 512 are both provided with a through hole, and the conductive contact 8 is clamped in the through hole through the boss. In such a way, the conductive contact 8 is installed conveniently.

Figure 6:
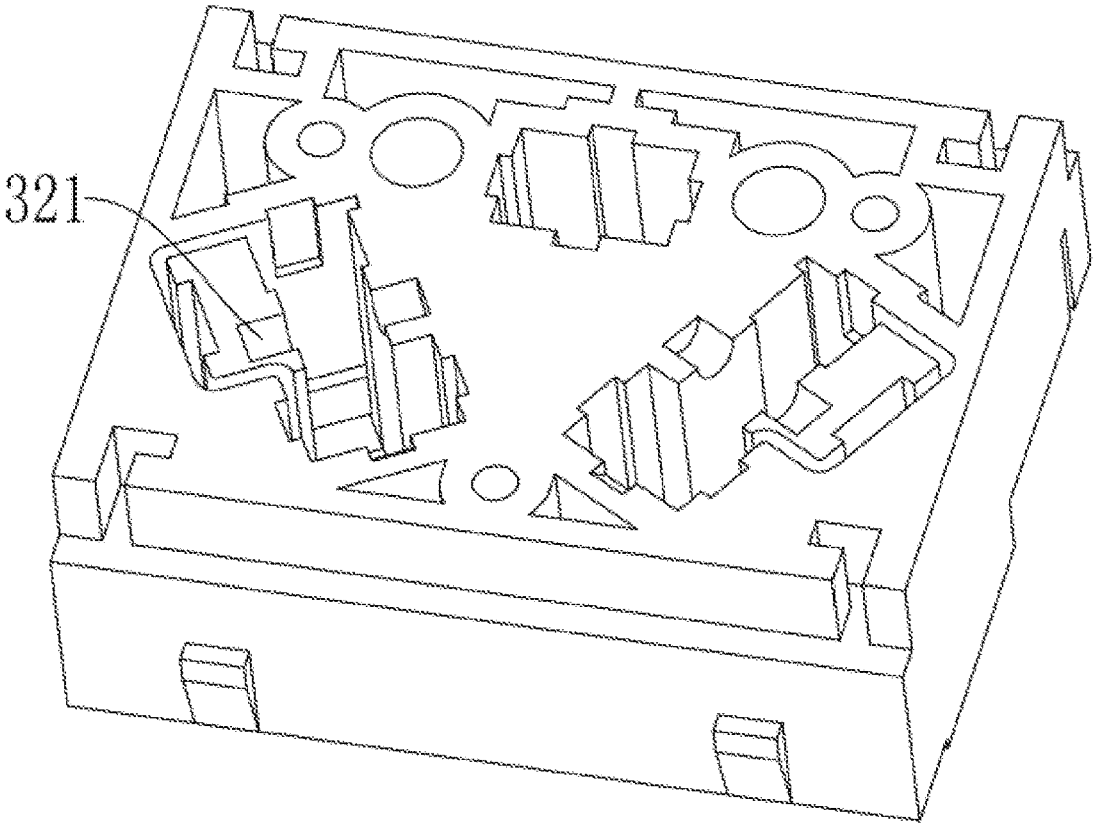
FIG. 6 is a schematic structural diagram of a fixing member of a socket plastic hardware structure device according to some embodiments.
Figure 9:
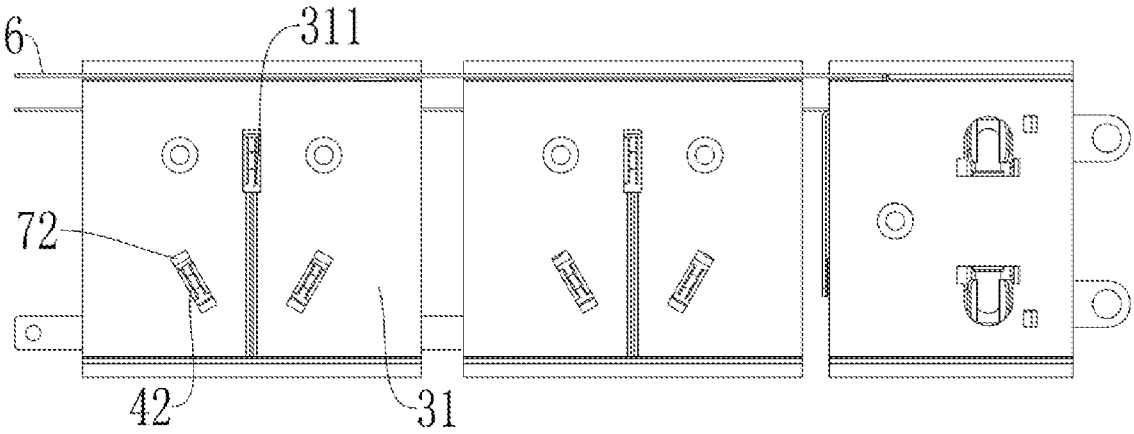
FIG. 9 is a projection diagram of a fixing structure of a socket plastic hardware structure device according to some embodiments.

The housing may comprise a bottom shell 1 and an upper shell 2. The bottom shell 1 is covered with an upper shell 2, the upper shell 2 is provided with the first socket 21, a fixing structure is further provided in the bottom shell 1, the fixing structure comprises a lower shell 33, an upper cover 31 and a fixing member 32, the lower shell 33 can be clamped to the bottom shell 1 through a clamping structure, the lower shell 33 is covered with the upper cover 31, the fixing member 32 is provided between the lower shell 33 and the upper cover 31, and the upper cover 31 is provided with a first semi-cylindrical groove 312 matching the rotating shaft portion 71 and a second socket 311 corresponding to the position of the first socket 21. As shown in FIG. 9, the first protrusion 72 protrudes from the edge of the second socket 311 in the direction perpendicular to the depth of the second socket 311 and is located below the second socket 311. As shown in FIG. 6, the fixing member 32 is provided with a second semi-cylindrical groove 321 matching the rotating shaft portion 71, the rotating shaft portion 71 is rotatably provided in a cylindrical groove formed by buckling the first semi-cylindrical groove 312 and the second semi-cylindrical groove 321, and the fixing member 32 is further provided with a neck for fixing the conductive piece 4 and the conductive part 5. The rotary connection formed by the cylindrical groove formed by buckling the rotating shaft portion 71, the first semi-cylindrical groove 312, and the second semi-cylindrical groove 321 can save space on the one hand, and facilitate installation on the other hand. The neck is provided so that the conductive piece 4 and the conductive piece 5, the rotating part 7, and the power cord connecting piece 6 are fixed more conveniently and firmly.

The socket plastic hardware structure device may also be provided with a USB interface 13, a circuit board 12 is provided in the bottom shell 1, and the circuit board 12 is electrically connected to the transformer 14 and the USB interface 13. It is convenient to use the USB cable to directly charge electronic products such as mobile phones and tablets.

Figure 12:
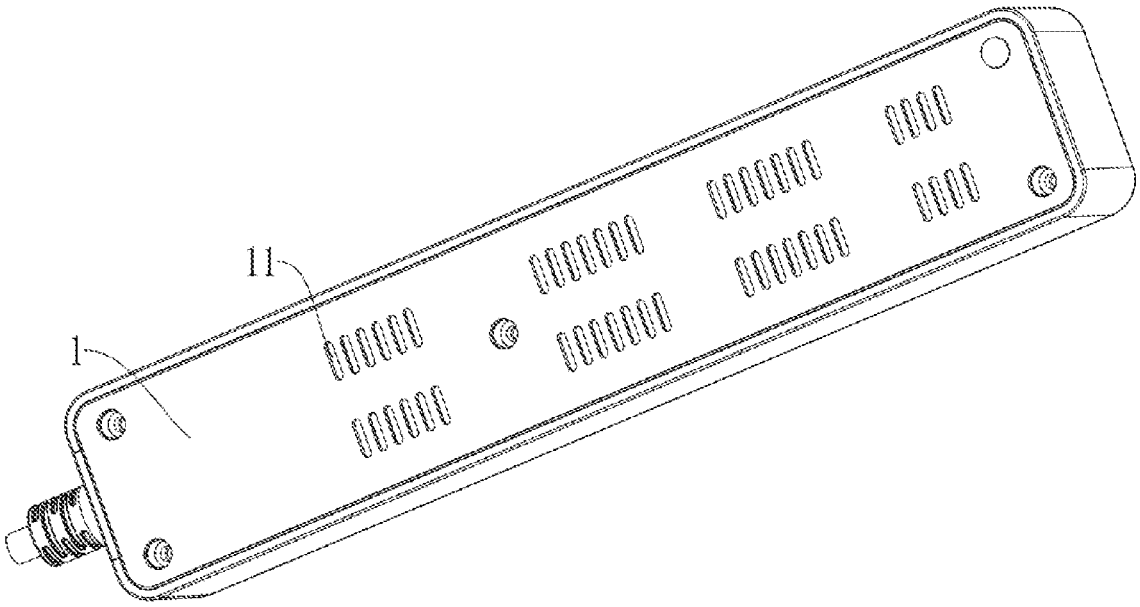
FIG. 12 is a diagram from another perspective of FIG. 1.
Figure 13:
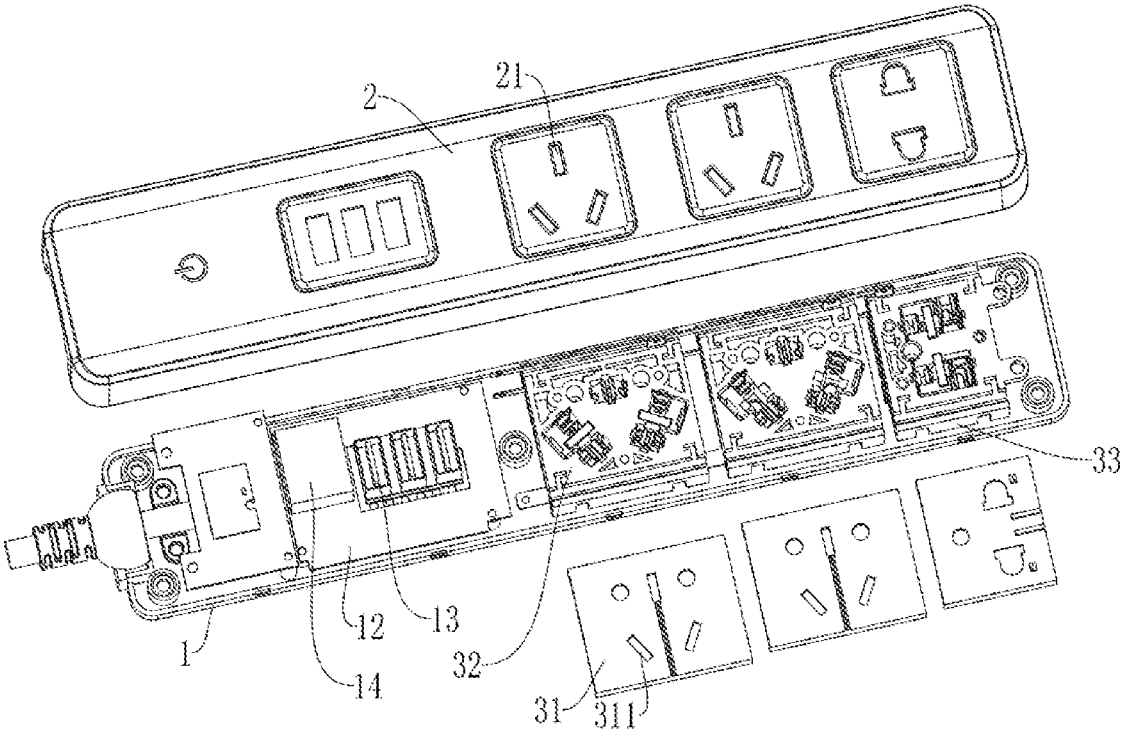
FIG. 13 is an exploded diagram of FIG. 1.

The bottom shell 1 is provided with a heat dissipation hole 11. As shown in FIG. 12, the heat dissipation hole 11 runs through the bottom shell 1, and can be arranged in a long strip shape on the bottom shell 1 at intervals. The bottom shell 1 is added so that the socket plastic hardware structure device dissipates heat better. If water enters the socket plastic hardware structure device, it can be discharged through the heat dissipation hole 11.

Figure 10:
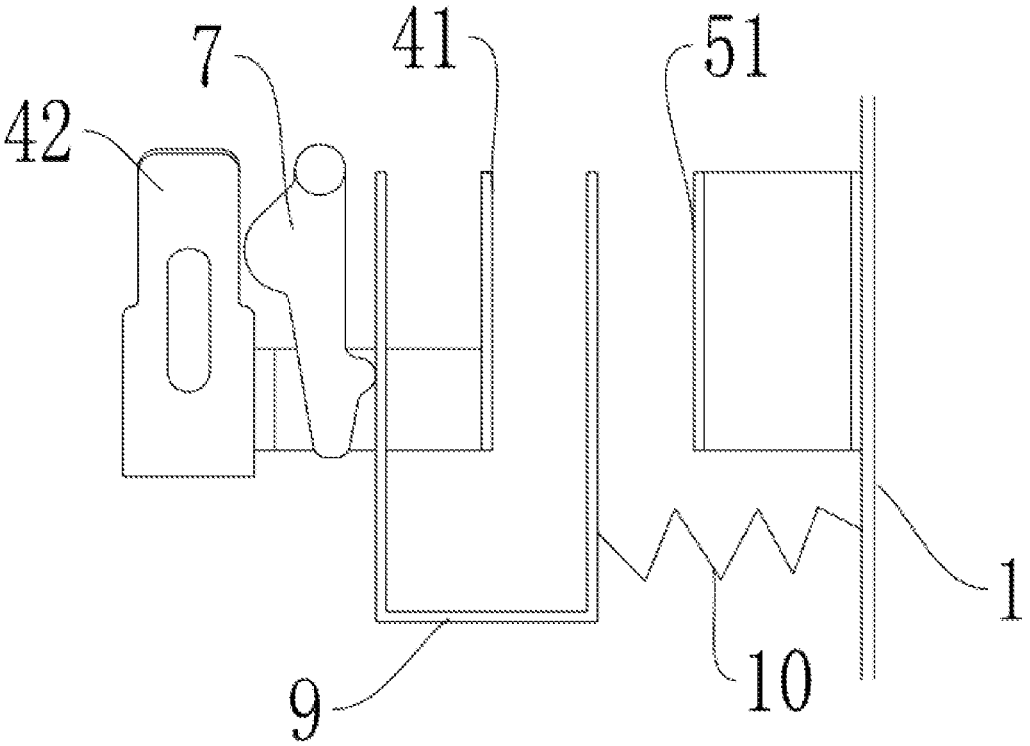
FIG. 10 is a schematic structural diagram of a connection relationship between a conductive part, a conductive piece, and a conductive connector of a socket plastic hardware structure device according to some embodiments.
Figure 11:
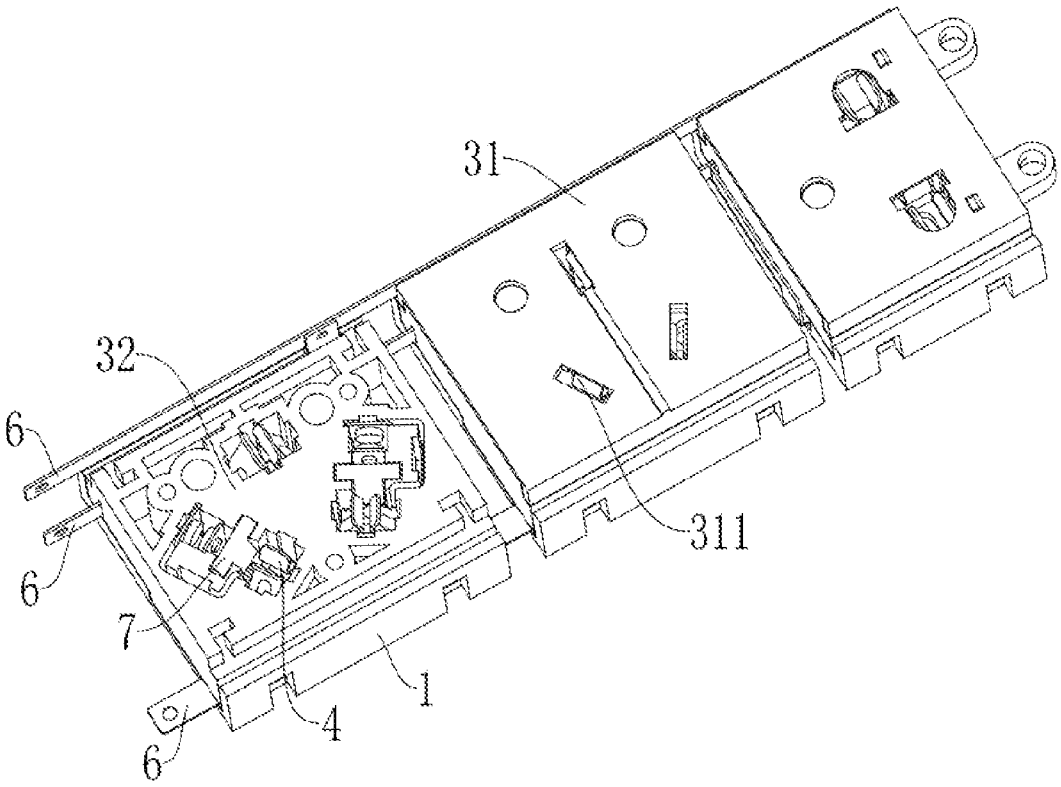
FIG. 11 is a schematic structural diagram of a fixing structure of a socket plastic hardware structure device according to some embodiments.

The present invention further provides a socket plastic hardware structure device, comprising a bottom shell 1 and an upper shell 2 covering the bottom shell 1, wherein the upper shell 2 is provided with a first socket 21, a conductive part 5 connected with a power cord connecting piece 6 and a conductive piece 4 in contact with a male tab of a plug are provided in the bottom shell 1, the conductive piece 4 is provided with a clamping portion 42 for clamping the male tab, and the clamping portion 42 is located directly below the first socket 21, wherein the conductive piece 4 is further provided with a first contact portion 41, the conductive part 5 is provided with a second contact portion 51, a gap is provided between the first contact portion 41 and the second contact portion 51, a rotating part 7 is rotatably provided in the bottom shell 1, the rotating part 7 is provided with a first protrusion 72 protruding in the direction of the edge of the first socket 21, the first protrusion 72 is located below the first socket 21, wherein the device further comprises a conductive connector 9, the conductive connector 9 is provided with two contact portions, one end of the conductive connector 9 is connected with an elastic member, the other end of the elastic member is connected with the inner wall of the bottom shell 1, the second end of the conductive connecting piece 9 is located on one side of the rotating part 7, when the male tab is inserted into the first socket 21, the male tab pushes the rotating part 7 to rotate and pushes the conductive connecting piece 9 to move until the two contact portions thereof are in contact with the first contact portion 41 and the second contact portion 51, respectively, and when the male tab is pulled out of the first socket 21, the elastic member returns to its original shape and pushes the conductive connector 9 until the two contact portions thereof are separated from the first contact portion 41 and the second contact portion 51, respectively. As shown in FIG. 10, the elastic member can be provided as a spring 10, the conductive connector 9 can be provided as a U-shaped plate, and two vertically provided plates are contact portions.

It should be noted that the bottom shell 1, the upper shell 2, the lower shell 33, the fixing member 32, and the upper cover 31 of the socket plastic hardware structure device can be made of environmentally friendly materials.

In addition, the present invention is applicable to the socket plastic hardware structure devices of any standard worldwide, including but not limited to a socket plastic hardware structure device of Chinese standard, a socket plastic hardware structure device of American standard, a socket plastic hardware structure device of Japanese standard, a socket plastic hardware structure device of Australian standard and so on. The drawings in the specification only take the socket plastic hardware structure device of Chinese standard as an example.

It can be understood that the same or similar parts in the foregoing embodiments may be referred to each other, and the contents not described in detail in some embodiments may refer to the same or similar contents in other embodiments.

Although the embodiments of the present invention have been shown and described above, it can be understood that the above embodiments are exemplary and should not be construed as limiting the present invention. Those skilled in the art can make changes, modifications, substitutions and modifications to the above embodiments within the scope of the present invention.

What is claimed is:

1. A socket plastic hardware structure device, comprising a housing provided with a first socket (21), wherein a conductive part (5) connected with a power cord connecting piece (6) and a conductive piece (4) in contact with a male tab of a plug are provided in the housing, the conductive piece (4) is provided with a clamping portion (42) for clamping the male tab, and the clamping portion (42) is located directly below the first socket (21), wherein the conductive piece (4) is further provided with a first contact portion (41) extending from the clamping portion (42), the conductive part (5) is provided with a second contact portion (51), a gap is provided between the first contact portion (41) and the second contact portion (51), the first contact portion (41) or the second contact portion (51) is provided in an elastic structure, a rotating part (7) made of insulating material is rotatably provided in the housing, the rotating part (7) is provided with a first protrusion (72) protruding in the direction of the edge of the first socket (21), the first protrusion (72) is located below the first socket (21), when the male tab is inserted into the first socket (21), the male tab pushes the rotating part (7) to rotate and thereby pushes one of the first contact portion (41) and the second contact portion (51) to elastically deform so as to approach and contact with the other of the first contact portion (41) and the second contact portion (51), when the male tab is pulled out of the first socket (21), the first contact portion (41) or the second contact portion (51) that has undergone elastic deformation recovers from the elastic deformation, and the first contact portion (41) is separated from the second contact portion (51).

2. The device according to claim 1, wherein the rotating part (7) further comprises a second protrusion (73) and a rotating shaft portion (71) rotatably provided on the housing, and the second protrusion (73) protrudes in the direction of the first contact portion (41) or the second contact portion (51).

3. The device according to claim 2, wherein the second contact portion (51) is provided as a horizontally provided horizontal plate (511) and a vertically provided second contact plate (512) which are connected vertically to each other, the first contact portion (41) is provided such that a vertically provided vertical plate (411) and a first contact plate (412) are vertically connected to each other, a gap is provided between the first contact plate (412) and the second contact plate (512), and the second contact plate (512) is located on one side of the rotating part (7).

4. The device according to claim 3, wherein the first contact plate (412) and the second contact plate (512) are both provided with conductive contacts (8) protruding toward each other at corresponding positions, and a gap is provided between the two conductive contacts (8).

5. The device according to claim 4, wherein the conductive piece (4) and the conductive part (5) are both formed by bending a copper plate.

6. The device according to claim 5, wherein the conductive contact (8) is provided with a boss, the first contact plate (412) and the second contact plate (512) are both provided with a through hole, and the conductive contact (8) is clamped in the through hole through the boss.

7. The device according to claim 6, wherein the housing comprises a bottom shell (1), the bottom shell (1) is covered with an upper shell (2), the upper shell (2) is provided with the first socket (21), a fixing structure is further provided in the bottom shell (1), the fixing structure comprises a lower shell (33), an upper cover (31) and a fixing member (32), the lower shell (33) is covered with the upper cover (31), the fixing member (32) is provided between the lower shell (33) and the upper cover (31), the upper cover (31) is provided with a first semi-cylindrical groove (312) matching the rotating shaft portion (71) and a second socket (311) corresponding to the position of the first socket (21), the fixing member (32) is provided with a second semi-cylindrical groove (321) matching the rotating shaft portion (71), the rotating shaft portion (71) is rotatably provided in a cylindrical groove formed by buckling the first semi-cylindrical groove (312) and the second semi-cylindrical groove (321), and the fixing member (32) is further provided with a neck for fixing the conductive piece (4) and the conductive part (5).

8. The device according to claim 7, wherein the device is further provided with a USB interface (13).

9. The device according to claim 8, wherein the bottom shell (1) is provided with a heat dissipation hole (11).

10. A device, comprising a bottom shell (1) and an upper shell (2) covering the bottom shell (1), wherein the upper shell (2) is provided with a first socket (21), a conductive part (5) connected with a power cord connecting piece (6) and a conductive piece (4) in contact with a male tab of a plug are provided in the bottom shell (1), the conductive piece (4) is provided with a clamping portion (42) for clamping the male tab, and the clamping portion (42) is located directly below the first socket (21), wherein the conductive piece (4) is further provided with a first contact portion (41) extending from the clamping portion (42), the conductive part (5) is provided with a second contact portion (51), a gap is provided between the first contact portion (41) and the second contact portion (51), a rotating part (7) is rotatably provided in the bottom shell (1), the rotating part (7) is provided with a first protrusion (72) protruding in the direction of the edge of the first socket (21), the first protrusion (72) is located below the first socket (21), wherein the device further comprises a conductive connector (9), the conductive connector (9) is provided with two contact portions, one end of the conductive connector (9) is connected with an elastic member, the other end of the elastic member is connected with the inner wall of the bottom shell (1), the second end of the conductive connecting piece (9) is located on one side of the rotating part (7), when the male tab is inserted into the first socket (21), the male tab pushes the rotating part (7) to rotate and pushes the conductive connecting piece (9) to move until the two contact portions thereof are in contact with the first contact portion (41) and the second contact portion (51), respectively, and when the male tab is pulled out of the first socket (21), the elastic member returns to its original shape and pushes the conductive connector (9) until the two contact portions thereof are separated from the first contact portion (41) and the second contact portion (51), respectively.

* * * * *